United States Patent [19]

Komatsu et al.

[11] 4,408,197

[45] Oct. 4, 1983

[54] PATTERN DISPLAY APPARATUS

[75] Inventors: Shigeru Komatsu, Yokohama; Kunihiko Nagai, Zushi; Takuo Koyama, Yokohama; Tsuguji Tachiuchi, Yokohama; Shigeru Hirahata, Yokohama, all of Japan

[73] Assignee: Hitachi, Ltd., Tokyo, Japan

[21] Appl. No.: 259,162

[22] Filed: Apr. 30, 1981

[30] Foreign Application Priority Data

May 8, 1980 [JP] Japan ..... 55-59891

[51] Int. Cl.[3] ..... G09G 1/16

[52] U.S. Cl. ..... 340/720; 340/723; 340/750

[58] Field of Search ..... 340/720, 723, 748, 750, 340/798, 799, 803, 804

[56] References Cited

U.S. PATENT DOCUMENTS 4,129,860 12/1978 Yonezawa ..... 340/750
4,199,757 4/1980 Ichimi ..... 340/750
4,308,532 12/1981 Murphy ..... 340/750
4,321,599 3/1982 Yoshiba ..... 340/750

*Primary Examiner*—Michael A. Masinick
*Attorney, Agent, or Firm*—Antonelli, Terry & Wands

[57] ABSTRACT

A display apparatus for use with a cathode-ray tube capable of displaying patterns in interlaced scanning and non-interlaced scanning operation modes, comprising a composite video signal synthesizer, a memory for storing pattern data, a mode setting circuit for the memory, a data selection signal generator and a raster line number signal generator. The memory stores data for relatively simple patterns such as alphabetical letters and those for relatively complicated patterns such as Chinese characters in individually particular areas in the memory addresses of these different areas are identified by a combination of the data selection signal and the raster line number signal supplied to the memory from the data selection signal generator and the raster line number signal generator. Accordingly, the apparatus is capable of displaying both relatively simple and relatively complicated patterns with satisfactory resolution and with a relatively small-scale structure.

7 Claims, 8 Drawing Figures

PATTERN DISPLAY APPARATUS

The present invention relates to a display apparatus for displaying patterns such as characters or the like on a cathode ray tube display device through raster scanning.

One of the principal applications of the cathode ray tube display apparatus, is pattern display apparatus for microcomputers and the like. Since microcomputers are primarily intended for personal use or at most for business purpose on a small scale, the display apparatus for use in combination with such a microcomputer has to be necessarily relatively low in cost. Under the circumstances, it is common to employ a general purpose cathode ray tube (hereinafter referred to as CRT) in the display apparatus for the microcomputer.

When patterns such as characters, signs, symbols and the like which are to be outputted from or inputted to the microcomputer are displayed on the general purpose CRT, a raster scan system is generally adopted. In most of the character or pattern display CRT's of this type, a composite picture or video signal is inputted directly to the CRT. Although a CRT having a higher resolution as compared with those employed in the television receivers for home use is used as the display device for the microcomputer, the operation system adopted for the CRT pattern display apparatus for the microcomputer is identical with the one adopted for the conventional television receiver, because priority is given to the general purpose use and reduction of the manufacturing cost of the CRT display apparatus. As a consequence, the horizontal scanning frequency $f_H$ is approximately equal to 15.75 KHz, while the vertical scanning frequency $f_V$ is approximately equal to 60 Hz.

Thus, when a display is produced through the so-called non-interlaced scanning without resorting to the interlaced scanning, the number $N_n$ of scanning lines amounts to only 262.5 because $N_n = 15750 \div 60$.

Further, since a flyback time is inevitably involved in the generation of a pattern display on the CRT, the number of the horizontal scanning lines within the actual display area will be reduced to about 200, assuming that the vertical flyback time occupies equivalently about 75% of the display area in the vertical direction. This means that the number of dots available for constituting a pattern or character display in the vertical direction is decreased to about 200. This results in such an inadequate resolution in the vertical direction that the display of symbols and characters of fine and complicated structures in a desired number of lines is rendered impracticable.

For example, in the case of generation of a display of an Arabic character, at least 12 dots and preferably 16 or more dots should be available for each character inclusive of an inter-line space in the vertical direction. The display of the Chinese characters will require at least 16 dots in the vertical direction even exclusive of the inter-line space.

It is tentatively assumed that the display of characters each constituted by 16 dots inclusive of the inter-line space in the vertical direction may be tolerated, but then the CRT in which only 200 scanning lines are available as described above will not allow more than about 12 lines of characters to be displayed simultaneously. This is unsatisfactory for many practical applications.

As an approach to solve the above problem, it may occur that the horizontal scanning frequency $f_H$ is increased to thereby increase correspondingly the number of the scanning lines. To this end, however, the CRT has to be realized in a design different from the general purpose CRT's. Besides, the reading of data to be displayed has to be performed at a higher speed so as to be compatible with the increased horizontal scanning frequency $f_H$, which in turn requires an expensive high speed memory for the display. Consequently, the display apparatus will not meet the requirement of inexpensiveness imposed on the display apparatus for the microcomputer or the like.

As another approach to solve the problem, it is conceivable that the number of the scanning lines is multiplied by an integer, e.g. by a factor of 2 by adopting interlaced scanning for the display. According to this approach, the number of the scanning lines can be made twice as large without varying the horizontal scanning frequency $f_H$ and the vertical scanning frequency $f_V$. Thus, the general purpose CRT can be used as it is without any fear of involving a large expense. However, if interlaced scanning is employed in the display of any kind of patterns, there may arise the inconvenience that flicker may occur in dependence on the font of characters to be displayed as well as the brightness thereof and the ambient illumination. Further, special consideration will have to be paid to phosphor decay characteristic of the CRT as used.

It will thus be appreciated that the above-described approaches are not satisfactory. By the way, the patterns such as characters to be displayed on the CRT encompasses many simple patterns such as the Roman alphabet and numerals in addition to the Arabic characters and the Chinese characters. For the display of such simple patterns, 8 dots in the vertical direction will be sufficient even inclusive of the inter-line space, which in turn means that the simultaneous display of up to about 25 lines can be accomplished on the conventional CRT of the general purpose type in which the number of the available scanning lines is only about 200. Therefore, it can be seen that for the display of the relatively simple patterns, the approaches which involve large expense and generation of flicker as described above provide substantially no advantages.

An object of the present invention is to provide an apparatus which is capable of displaying relatively simple patterns and relatively complicated patterns with an inexpensive structure on a reduced scale.

According to one aspect of the invention, the display apparatus is so arranged that it can be operated exchangeably or alternatively in an interlaced scanning mode and a non-interlaced scanning mode.

In a preferred exemplary embodiment of the invention, there is proposed a display apparatus for use with a cathode-ray tube capable of displaying patterns in interlaced scanning and non-interlaced scanning operation modes, comprising means for synthesizing a signal to be supplied to the cathode-ray tube, means storing data of patterns, means for setting the storing means to one of the two operation modes depending upon the complexity of patterns to be displayed, means generating a data selection signal for reading pattern data in the storing means in accordance with information to be displayed and supplying the pattern data signals to the signal synthesizing means for synthesizing a signal carrying the information to be displayed, and means for generating a raster line number signal indicative of a scanning line being produced on the cathode-ray tube, the data selection signal and the raster line number signal serving in combination as an access signal to the storing means, during the data reading operation.

The present invention will now be described by way of example only with reference to the accompanying drawings, in which.

Figure 2:
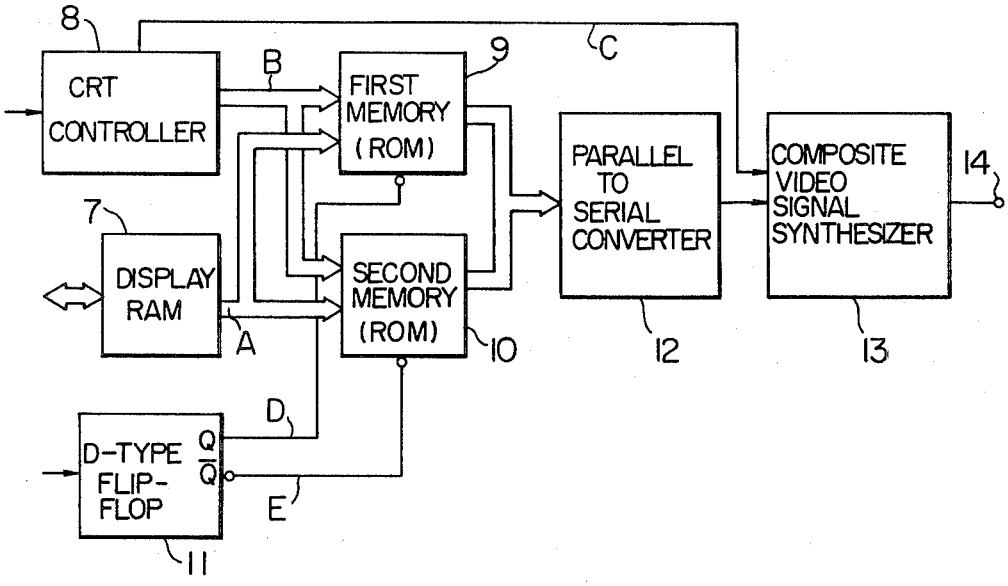
FIG. 2 is a block diagram showing a display apparatus according to an embodiment of the invention.
Figure 3A:
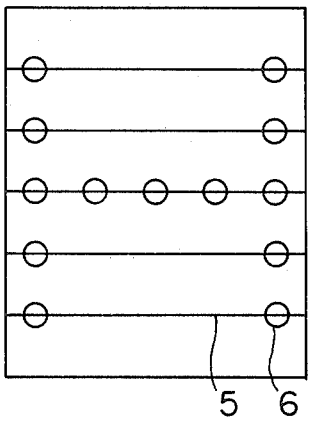
Figure 3B:
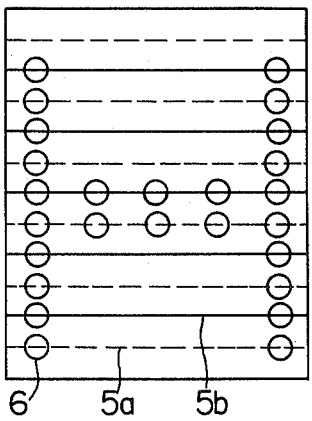
Figure 4:
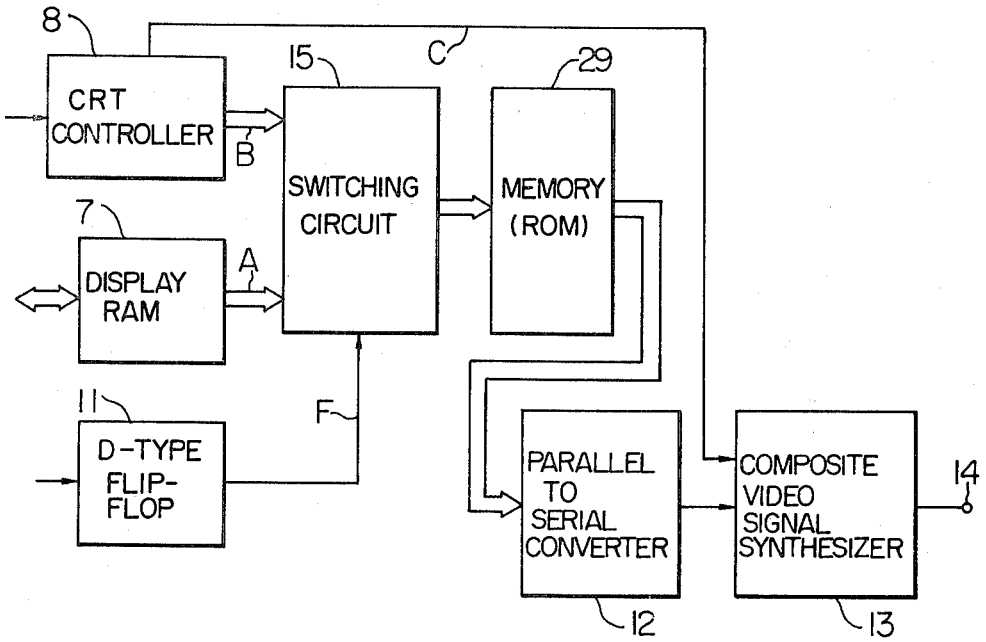
Figure 5A:
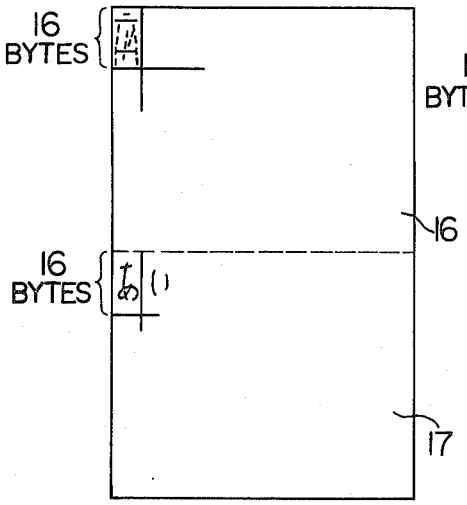
Figure 5B:
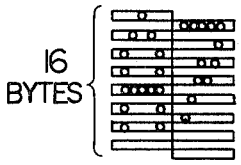
Figure 6:
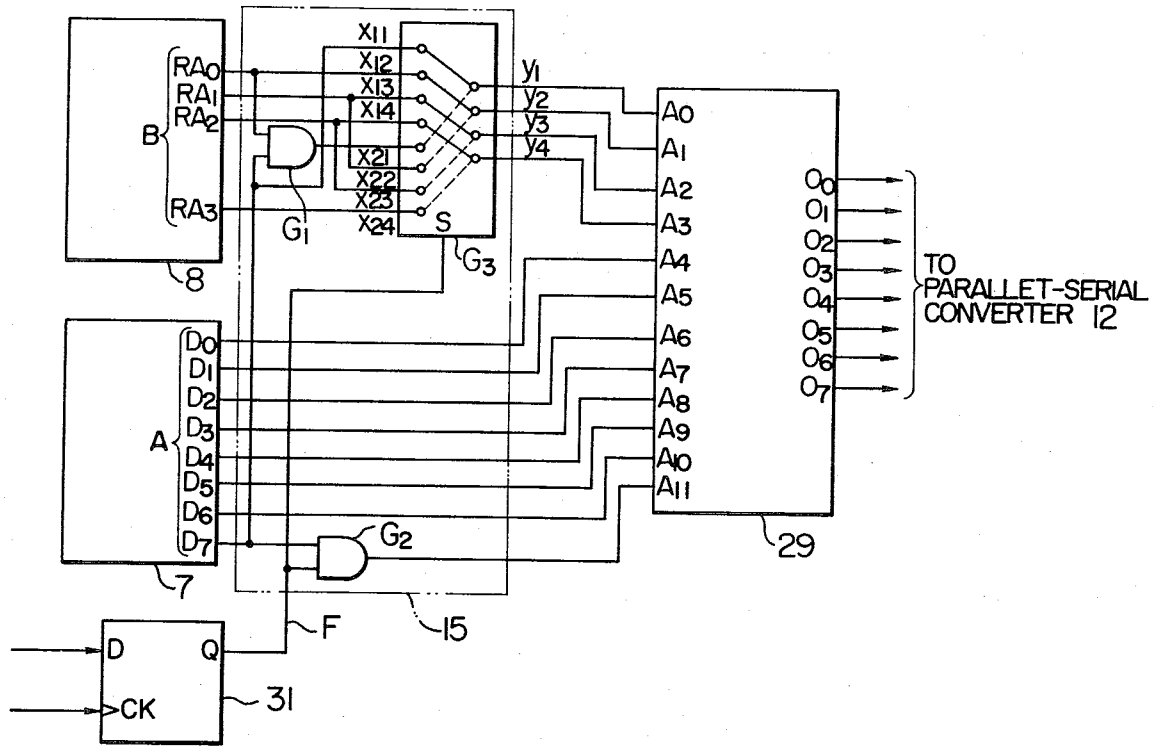

FIGS. 3*a* and 3*b* illustrate examples of characters displayed by the display apparatus shown in FIG. 2;

FIG. 4 is a block diagram showing a display apparatus according to another embodiment of the invention;

FIGS. 5*a* and 5*b* illustrate manners in which pattern data are recorded in a recording means which may be used in carrying out the invention; and FIG. 6 shows a reading circuit for a pattern data recording device which may be employed in carrying out the invention.

Figure 1:
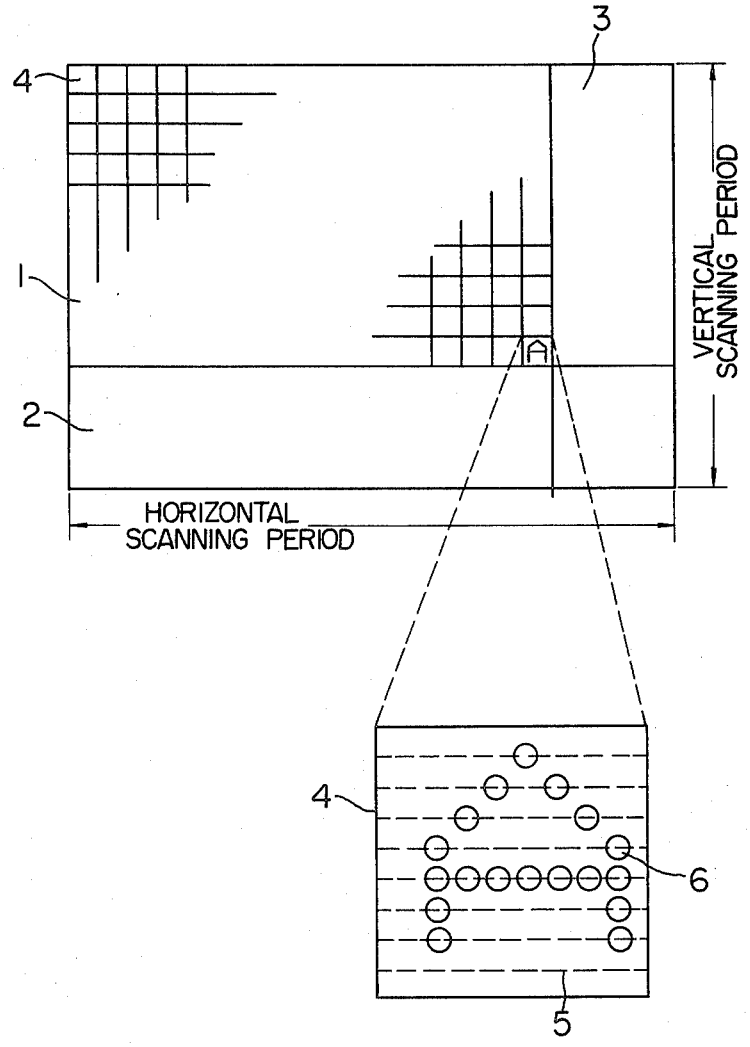
FIG. 1 illustrates a structure of a character displayed on a display device.

In FIG. 1, reference numeral 1 denotes a display region on a screen of a CRT which corresponds to a single frame period and is determined by a vertical blanking period 2 and a horizontal blanking period 3. Reference numeral 4 denotes cell areas, 5 denotes horizontal scanning lines, and 6 denotes dots constituting patterns, e.g. characters. The display region 1 is divided in both the horizontal and vertical directions into a number of the cell areas in accordance with patterns such as characters and the like to be displayed. The cell area 4 is divided in both horizontal and vertical directions into the dots 6 for displaying a pattern such as a character or the like. Since the pattern constituting dots makes its appearance in the vertical direction only at those locations which correspond to the horizontal scanning lines 5, the number of the pattern constituting dots 6 in the vertical direction cannot be made greater than the number of the horizontal scanning lines 5.

The individual cell areas 4 correspond to respective particular addresses of a random access memory (hereinafter referred to as RAM) for display, as will be described hereinafter, whereby a pattern to be displayed on a given cell area 4 of the display region 4 is particularly determined in dependence on the pattern area stored at such addresses in the RAM as corresponding to the given cell area 4.

In this manner, by writing output data from a microcomputer or the like into the RAM for display at predetermined addresses, it is possible to display corresponding patterns such as characters.

Referring to FIG. 2 showing an exemplary embodiment of the present invention, reference numerals 9 and 10 denote means storing data for constituting patterns such as characters, signs, symbols and the like (these data being hereinafter referred to as pattern data). The storing means include a first memory and a second memory each constituted by a read-only memory or ROM. The first memory 9 serves to mainly store data for relatively complicated patterns such as Chinese characters and symbols of intricate structures, while the second memory 10 serves to mainly store data for relatively simple patterns such as alphabetical characters, symbols of less intricate structures and the like. Each of the ROM's 9 and 10 is supplied with a raster number signal B from a CRT controller 8 and a data selection signal A from the display RAM 7, respectively. These signals are combined to form access signals to the memories 9 and 10 for reading out the pattern data. The first and the second memories 9 and 10 are alternatively operated in response to memory selection signals D and E which are in opposite phase to each other and supplied from a D-type flip-flop 11, whereby the pattern data read out in accordance with the access signals formed by the signals A and B is sent out in parallel for each pattern (pattern by pattern) as a parallel data signal. The parallel data signal is converted to a serial data signal through a parallel-serial converter circuit 12 and supplied to a composite video signal synthesizing circuit 13 which is also supplied with a control signal C including a synchronizing signal, a blanking signal and the like from the CRT controller 8 for synthesizing a composite video signal which is suited to be supplied to a CRT (not shown). The control signal C may not be supplied to the circuit 13 but may be supplied to the CRT through another circuit so that the circuit 13 synthesizes a signal carrying video information for supply to the other circuit.

The CRT controller 8 is also adapted to produce various clock signals and timing signals required for the display operation in addition to the raster number signal B and the control signal C. The controller 8 may be implemented by a commercially available CRT controller such as HD-46505S manufactured by Hitachi, Ltd. Reference numeral 14 denotes an output terminal for the composite video signal.

The display RAM 7 stores code data indicative of information to be displayed that may be supplied from a microcomputer or the like. During the display period, the code data is sequentially read out periodically with a predetermined timing to constitute the pattern data selection signal A which is then inputted to the first and the second memories 9 and 10. The display RAM 7 may be constituted by a dynamic RAM HM-4716A commercially available from Hitachi, Ltd.

The pattern data selection signal A is what is produced by encoding patterns such as characters to be displayed and is constituted on the cell area base, while the raster number signal B is a signal indicative of which scanning line is being currently generated for the dots arranged in matrix for constituting a pattern such as a character or the like to be displayed.

The first and second memories 9 and 10 for the pattern generation are adapted to produce on one scanning line base a parallel bit data signal of a length corresponding to the width or the size of one pattern or character and including, for example, logic "1's" to the dots of the character font to be lit and logic "0's" corresponding to the dots not to be lit on the basis of the data selection signal A supplied from the display RAM 7 and the raster number signal B from the CRT controller 8. The memories 9 and 10 may be implemented, respectively, by a ROM "2332" and a ROM "2316" manufactured by Texas Instruments Incorporated, for example. The logic states of the Q and $\overline{Q}$ outputs of the D-type flip-flop 11 are determined by a mode switching signal, e.g. a mode switching signal available from the microcomputer (not shown) such that one of the memory selection signals D and E is logic "1" while the other is logic "0". As a consequence, the parallel bit data signal mentioned above makes appearance only at the output of one of the memories 9 and 10 which has a chip selection terminal supplied with the logic "0" signal, while no data is read out from the other memory.

The parallel bit data signal is then converted to a serial bit data signal through the parallel-to-serial conversion circuit 12 which may be constituted by a shift register and thereafter supplied to the video signal synthesizing circuit 13 to be combined with the horizontal and the vertical synchronizing signals contained in the control signal C from the CRT controller 8. The synthesized signal output produced from the output terminal 14 of the circuit 14 is then supplied to the CRT to be displayed as information or message including a plurality of patterns such as characters and the like. The memory 9 for storing data for relatively complicated patterns has a structure operative in the interlaced scanning mode, while the other memory 10 has a structure operative in the non-interlaced scanning mode. Since the number of the scanning lines produced in the interlaced scanning operation mode is doubled as compared with the non-interlaced scanning operation mode, the raster number signal B derived from the CRT controller 8 is required to be indicative of the doubled number of the scanning lines. Thus, when, the signal B is a binary signal it must be lengthened by one bit in the interlaced scanning operation mode. Further, the number of dots which take part in the display in the vertical direction in the interlaced scanning operation mode is also doubled as compared with the non-interlaced scanning operation mode. Accordingly, the first memory 9 for the interlaced scanning operation mode has a storage capacity twice as large as that of the second memory 10 for the non-interlaced scanning operation mode.

It is now assumed that a value placed in an internal register in the CRT controller 8 is set for the non-interlaced scanning operation mode by an appropriate signal derived from the microcomputer, for example, while the D-type flip-flop 11 is simultaneously set so that the signal E is logic "0". Under these conditions, the parallel bit data signal is read out only from the second memory 10 for the non-interlaced scanning operation mode, whereby a display such as illustrated in FIG. 3*a*, for example, is produced through cooperation of the data selection signal A supplied from the display RAM 8, the raster number signal B supplied from the CRT controller 8 and the control signal C including the synchronizing signals for the non-interlaced scanning operation mode. In FIG. 3*a*, there is illustrated an alphabetical character "H" displayed in the non-interlaced scanning operation mode for a case where the unit character area or the cell area 4 (FIG. 1) is constituted by a 5 bits×5 bits matrix.

When the mode selection signal supplied from, e.g., the microcomputer is set for the interlaced scanning operation mode, the value placed in the internal register of the CRT controller 8 is changed for the interlaced scanning operation mode, while the D-type flip-flop 11 is reset, with a result that the signal D is in turn logic "0". As a consequence, the first memory 9 for the interlaced scanning operation mode is selected, whereby a display such as one illustrated in FIG. 3*b*, for example, is produced on the CRT screen on the basis of the data selection signal A supplied from the display RAM 7, the raster number signal B supplied from the CRT controller 8 and the control signal C including the synchronizing signals for the interlaced scanning operation mode. In the case of the illustration of FIG. 3*b*, the same alphabetical character "H" as the one shown in FIG. 3*a* is displayed. However, because of the display in the interlaced scanning operation mode, the scanning lines 5*a* and 5*b* of the odd-numbered field and the even-numbered field, respectively, are combined to increase the total number of the scanning lines twice as large as compared with those in the non-interlaced scanning operation mode. As a result, the number of dots in the vertical direction is also doubled to 10 dots.

As will be appreciated from the foregoing description, it is possible with the structure of the display apparatus according to the invention shown in FIG. 2 to change over the display operation between the interlaced scanning mode and the non-interlaced scanning mode in a selective manner as desired. By virtue of this feature, an adequately high resolution can be obtained from the display which includes a number of complicated patterns such as Chinese and Arabic characters by using the interlaced scanning mode, while the non-interlaced scanning operation mode which is not suceptible to the flicker effect may be selected for the display of relatively simple patterns including the numerals, alphabetical letters and the like.

FIG. 4 shows another embodiment of the invention, which is so arranged that the a storing means of a relatively small capacity may be sufficient for storing the pattern data. In this figure, the elements or components which are identical with or equivalent to those shown in FIG. 2 are denoted by the same reference symbols as those used in FIG. 2. The following description wil be made only on those portions of the display system shown in FIG. 4 which differ from the apparatus described above in conjunction with FIG. 2.

In FIG. 4, reference numeral 15 denotes a switching circuit. In the case of the display apparatus shown in this figure, the pattern data storing means is constituted by a single memory 29 which is so arranged as to be operative in the interlaced scanning operation mode when the mode control signal F produced from the D-type flip-flop 11 is logic "1", while it is operative in the non-interlaced scanning mode when the mode control signal F is logic "0". The principle of recording a character font in this display apparatus is illustrated in FIGS. 5*a* and 5*b*.

Referring to FIG. 5*a*, reference numeral 16 denotes a first memory portion of the single memory 29 with a second memory portion thereof being denoted by numeral 17. The first memory portion 16 serves to mainly store patterns such as fonts of characters and the like which are operable in common in the interlaced scanning operation mode and the non-interlaced scanning operation mode, while the second memory portion 17 serves to mainly store patterns such as the character font or the like which are to be operable only in the interlaced scanning mode. In the first memory portion 16 constituting the common operation mode memory portion, there are stored data for relatively simple patterns such as numerals, alphabetical letters and the like each, e.g., in eight bytes. More particularly, 16 bytes form a unit of storage so that data for two pattern are located at odd-numbered addresses, 16 in such a manner that data for one pattern are located at even-numbered addresses and data for the other pattern are located at odd-numbered addresses, namely, the data for the two patterns are alternately located in a 16-byte storage unit, as illustrated in FIG. 2*b*. On the other hand, there are stored in the second memory portion 17 relatively complicated patterns such as Chinese characters, intricate symbols or the like with 16 bytes being allotted to each of patterns or characters. In other words, the number of data digits per unit pattern is greater in the second memory portion 17 than in the first memory portion 16. The single memory 29 may be, e.g., implemented by using a ROM "2332".

The switching circuit 15 receives the data selection signal A from the display RAM 7 and the raster number signal B from the CRT controller 8 to translate these signals A and B to predetermined address signals in accordance with the mode control signal F which is supplied from the D-type flip-flop 11 and effective for establishing selectively either the interlaced scanning mode or the non-interlaced scanning mode. The single memory unit 29 responds to the address signals to produce parallel bit data signals for a plurality of patterns which constitute information or message to be displayed. The parallel bit data signal is then supplied to the parallel-to-serial converter 12. The composite video signal synthesizing circuit 13 is so arranged as to receive the control signal C from the CRT controller 8 and the serial bit data signal from the converter 12 to thereby produce the corresponding synthesized video signal.

In operation, when the display apparatus is operated in the non-interlaced scanning mode under the corresponding command from a microcomputer (not shown), for example, the CRT controller 8 supplies to the synthesizing circuit 13 the control signal C including the synchronizing signals corresponding to the non-interlaced scanning mode. The mode control signal F produced from the D-type flip-flop 11 takes the logic level "0", with a result that the switching circuit 15 is changed over to the position corresponding to the non-interlaced scanning operation mode. On these conditions, pattern data such as the character font or the like are read out only from the first memory portion 16 of the single memory 29 to be displayed.

In operation in the interlaced scanning operation mode, the CRT controller 8 produces the control signal C including the corresponding synchronizing signals, while the mode control signal F produced from the D-type flip-flop 11 is changed to logic "1" level. As a result, the switching circuit 15 is changed over to the position corresponding to the interlaced scanning operation mode. In this case, the pattern data for the character font and the like are read out from the first memory portion 16 and the second memory portion 17 of the single memory unit 19 in dependence on the data selection signal A supplied from the display RAM 7 and are displayed on the CRT. In this case, it is to be noted that the pattern data for a character font and the like are stored in the first memory portion 16 in a number of bytes which corresponds to the display in the non-interlaced scanning mode, e.g. 8 bytes as illustrated in detail in FIG. 5*b*. Accordingly, each address is accessed to twice through switching operation of the switching circuit 15 during one odd-numbered field and the one even-numbered field which succeed to each other to constitute one frame, as will hereinafter be described in detail.

In this manner, since the pattern data for the relatively simple patterns such as numerals, alphabetical letters (characters) and the like are stored in the first memory portion 16 operable both in the interlaced and non-interlaced scanning operation modes, when the display apparatus is operated in the interlaced scanning operation mode, they can be read out from the first memory portion 16 of the single memory 29, and the relatively simple patterns need not be stored in the second memory portion 17 for exclusive use in the interlaced scanning operation mode, i.e., the corresponding pattern data stored in the first memory portion 16 allotted for the non-interlaced scanning operation mode can be read out for use in common also in the interlaced scanning operation. This means that the storage capacity of the storing means for storing the pattern data can be reduced to a smaller one than the total storage capacity of the ROM's 9 and 10 of the display apparatus shown in FIG. 2.

A circuit arrangement for reading out the data contained in the single memory 29 with the aid of the switching circuit 15 is shown in FIG. 6.

In the case of the illustrated embodiment, it is assumed that the pattern data selection signal A outputted from the display RAM 7 contains eight bits ($D_0$, $D_1$, . . . , $D_7$), the number of the scanning lines for each pattern is equal to eight in the non-interlaced scanning operation mode and sixteen in the interlaced scanning operation mode, the raster number signal B thus contains four bits ($RA_0$, $RA_1$, $RA_2$ and $RA_3$), and that the single memory 29 has a storage capacity of 4K bytes and is provided with input terminals $A_0$, . . . , $A_{11}$ and output terminals $O_0$, . . . , $O_7$.

The switching circuit 15 includes a first switching circuit means including an AND circuit $G_1$ and a switch unit $G_3$ and a second switching circuit means including an AND circuit $G_2$. The switch unit $G_3$ has eight input terminals $x_{11}$, . . . , $x_{14}$; $x_{21}$, . . . , $x_{24}$ and four output terminals $y_1$, . . . , $y_4$ as well as a set terminal s and has such a structure that when the mode control signal F applied to the set terminal s is logic "O", the output terminals $y_1$, . . . , $y_4$ are connected to the input terminals $x_{11}$, . . . , $x_{14}$, respectively, as indicated by solid lines, while the output terminals $y_1$, . . . , $y_4$ are connected to the input terminals $x_{21}$, . . . , $x_{24}$, respectively, as indicated by broken lines, when the signal F is logic "1". The bit terminals $RA_0$, . . . , $RA_3$ at which the raster number signal B appears are connected to the AND circuit $G_1$ and the input terminals $x_{11}$, . . . , $x_{14}$; $x_{21}$, . . . , $x_{24}$ of the switch unit $G_3$ in such a manner that the bit terminal $RA_0$ is connected to the terminal $x_{12}$ and a first input terminal of the AND circuit $G_1$, the bit terminal $RA_1$ is connected to the terminals $x_{13}$ and $x_{22}$, $RA_2$ is connected to the terminals $x_{14}$ and $x_{23}$, and the bit terminal $RA_3$ is connected to the terminal $x_{24}$. The most significant bit terminal $D_7$ of the bit terminals $D_0$, . . . , $D_7$ at which the data selection signal A appears is connected to a second input terminal of the AND circuit $G_1$ and the inpt terminal $x_{11}$ of the switch unit $G_3$. The output terminal of the AND circuit $G_1$ is connected to the input terminal $x_{21}$ of the switch unit $G_3$. In the raster number signal B, $RA_0$ represents the least significant bit with $RA_3$ representing the most significant bit. The output terminals $y_1$, . . . , $y_4$ of the switch unit $G_3$ are connected to the input terminals $A_0$, . . . , $A_3$ of the single memory 29, respectively. The bit terminals $D_0$, . . . , $D_6$ for the data selection signal A are connected to the input terminals $A_4$, . . . , $A_{10}$ of the single memory 29, respectively, by way of the switching circuit 15. The most significant bit terminal $D_7$ is additionally connected to the first input terminal of the AND circuit $G_2$. The Q output terminal of the D-type flip-flop 31 from which the mode control signal F is produced is connected to the set terminal s of the switch unit $G_3$ and the second input terminal of the AND circuit $G_2$ which has the output terminal connected to the input terminal $A_{11}$ of the single memory 29. The D-type flip-flop 31 is of an edge trigger type and has a D input terminal and a clock input terminal CK.

The access signal produced at the input terminals of the single memory comprises a first access signal portion obtained at the bit terminals $A_0$, . . . , $A_3$ and a second signal portion obtained at the bit terminals $A_4, \ldots, A_{11}$. Each of these access signal portions constitute two types of signals in dependence on the logic state of the mode control signal F. In these access signal portions, $A_3$ and $A_{11}$ represent the respective most significant bits.

Next, the operation of this embodiment will be described.

In operation in the non-interlaced scanning mode, the D-type flip-flop 31 produces at the Q-output terminal thereof the mode control signal F in logic "0" state, with a result that connection in the switch unit $G_3$ is established in the manner indicated by the solid lines. More particularly, the most significant bit output terminal $D_7$ for the data selection signal A supplied from the display RAM 7 is connected to the least significant bit input terminal $A_0$ of the single memory 29. The least significant bit output terminal $RA_0$ for the raster number signal B supplied from the CRT controller 8 is connected to the input bit terminal $A_1$ of the single memory 29. The output bit terminal $RA_1$ is connected to the input terminal $A_2$. The output bit terminal $RA_2$ is connected to the input bit terminal $A_3$. The output bit terminals $D_0$ to $D_6$ are connected to the input terminals $A_4$ to $A_{10}$, respectively. Finally, the logic "0" bit is coupled to the most significant input bit terminal $A_{11}$. Accordingly, the logic states of the bit input terminals $A_0, \ldots, A_3$ (corresponding to the first access signal portion) and the bit input terminals $A_4, \ldots, A_{11}$ (corresponding to the second access signal portion) of the single memory unit 29 are such as listed in Tables 1 and 2.

TABLE 1

($D_7$ = "0")

| SECOND ACCESS SIGNAL PORTION | | | | | | | | FIRST ACCESS SIGNAL PORTION | | | | |
|---|---|---|---|---|---|---|---|---|---|---|---|---|
| $A_{11}$ | $A_{10}$ | $A_9$ | $A_8$ | $A_7$ | $A_6$ | $A_5$ | $A_4$ | $A_3$ | $A_2$ | $A_1$ | $A_0$ | DECIMAL NOTATION |
| 0 | $D_6$ | $D_5$ | $D_4$ | $D_3$ | $D_2$ | $D_1$ | $D_0$ | $RA_2$ | $RA_1$ | $RA_0$ | $D_7$ | |
| 0 | 0 | 0 | 0 | 0 | 0 | 0 | 0 | 0 | 0 | 0 | 0 | 0 |
| 0 | 0 | 0 | 0 | 0 | 0 | 0 | 1 | 0 | 0 | 1 | 0 | 2 |
| 0 | 0 | 0 | 0 | 0 | 0 | 1 | 0 | 0 | 1 | 0 | 0 | 4 |
| 0 | 0 | 0 | 0 | 0 | 0 | 1 | 1 | 0 | 1 | 1 | 0 | 6 |
| | | | | | | | | 1 | 0 | 0 | 0 | 8 |
| | | | | | | | | 1 | 0 | 1 | 0 | 10 |
| | | | | | | | | 1 | 1 | 0 | 0 | 12 |
| | | | | | | | | 1 | 1 | 1 | 0 | 14 |
| 0 | 1 | 1 | 1 | 1 | 1 | 1 | 0 | | | | | |
| 0 | 1 | 1 | 1 | 1 | 1 | 1 | 1 | | | | | |

128 Signals — 8 Signals

TABLE 2

($D_7$ = "1")

| SECOND ACCESS SIGNAL PORTION | | | | | | | | FIRST ACCESS SIGNAL PORTION | | | | |
|---|---|---|---|---|---|---|---|---|---|---|---|---|
| $A_{11}$ | $A_{10}$ | $A_9$ | $A_8$ | $A_7$ | $A_6$ | $A_5$ | $A_4$ | $A_3$ | $A_2$ | $A_1$ | $A_0$ | DECIMAL NOTATION |
| 0 | $D_6$ | $D_5$ | $D_4$ | $D_3$ | $D_2$ | $D_1$ | $D_0$ | $RA_2$ | $RA_1$ | $RA_0$ | $D_7$ | |
| 0 | 0 | 0 | 0 | 0 | 0 | 0 | 0 | 0 | 0 | 0 | 1 | 1 |
| 0 | 0 | 0 | 0 | 0 | 0 | 0 | 1 | 0 | 0 | 1 | 1 | 3 |
| 0 | 0 | 0 | 0 | 0 | 0 | 1 | 0 | 0 | 1 | 0 | 1 | 5 |
| 0 | 0 | 0 | 0 | 0 | 0 | 1 | 1 | 0 | 1 | 1 | 1 | 7 |
| | | | | | | | | 1 | 0 | 0 | 1 | 9 |
| | | | | | | | | 1 | 0 | 1 | 1 | 11 |
| | | | | | | | | 1 | 1 | 0 | 1 | 13 |
| | | | | | | | | 1 | 1 | 1 | 1 | 15 |
| 0 | 1 | 1 | 1 | 1 | 1 | 1 | 0 | | | | | |
| 0 | 1 | 1 | 1 | 1 | 1 | 1 | 1 | | | | | |

128 signals — 8 Signals

As will be seen from the above tables, in the non-interlaced scanning mode, only the first memory portion 16 of the single memory 29 is selected. In this connection, when the most significant bit $D_7$ of the data selection signal A is logic "0", even-numbered addresses of the first memory portion 16 of the single memory 29 and hence the pattern data such as data of a character illustrated on the right-hand side in FIG. 5*b* are selectively read out, while odd-numbered addresses of the first memory portion 16 and hence the pattern data such as data of a character illustrated on the left-hand side in FIG. 5*b* are selectively read out when the most significant bit $D_7$ is logic "1", whereby the display is accomplished in the non-interlaced scanning mode.

In the case of the interlaced scanning operation mode, the D-type flip-flop 11 produces at the Q-output terminal thereof the mode control signal F in logic "1" state, with a result that connection in the switch unit $G_3$ is made in such a manner as indicated by the broken lines.

Additionally, the AND circuit $G_2$ is enabled. Under these conditions, when the most significant output bit terminal $D_7$ for the data selection signal A supplies from the display RAM 7 is logic "0", the bit signal of logic "0" is applied to the input bit terminal $A_0$ of the single memory 29, while the terminal $A_0$ is connected to the least significant bit terminal $RA_0$ for the raster number signal B supplied from the CRT controller 8, when the output bit terminal $D_7$ is at logic "1" level. Additionally, the output bit terminal $RA_1$ is connected to the input bit terminal $A_1$, the output bit terminal $RA_2$ is connected to the input bit terminal $A_2$, the output bit terminal $RA_3$ is connected to the input bit terminal $A_8$, and the output bit terminals $D_0, \ldots, D_7$ for the data selection signal A supplied from the display RAM 7 are connected to the input bit terminals $A_4, \ldots, A_{11}$, respectively. Thus, the logic states at the bit input terminals $A_0, \ldots, A_3$ (corresponding to the first access signal portion) of the single memory 29 and at the bit input terminals $A_4 \ldots, A_{11}$ (corresponding to the second access signal portion) are such as summarized in Tables 3 and 4.

TABLE 3

($D_7$ = "0")

| SECOND ACCESS SIGNAL PORTION | | | | | | | | FIRST ACCESS SIGNAL PORTION | | | | |
|---|---|---|---|---|---|---|---|---|---|---|---|---|
| $A_{11}$ | $A_{10}$ | $A_9$ | $A_8$ | $A_7$ | $A_6$ | $A_5$ | $A_4$ | $A_3$ | $A_2$ | $A_1$ | $A_0$ | DECIMAL NOTATION |
| $D_7$ | $D_6$ | $D_5$ | $D_4$ | $D_3$ | $D_2$ | $D_1$ | $D_0$ | $RA_3$ | $RA_2$ | $RA_1$ | 0 | |
| 0 | 0 | 0 | 0 | 0 | 0 | 0 | 0 | 0 | 0 | 0 | 0 | 0 |
| 0 | 0 | 0 | 0 | 0 | 0 | 0 | 1 | 0 | 0 | 0 | 0 | 0 |
| 0 | 0 | 0 | 0 | 0 | 0 | 1 | 0 | 0 | 0 | 1 | 0 | 2 |
| 0 | 0 | 0 | 0 | 0 | 0 | 1 | 1 | 0 | 0 | 1 | 0 | 2 |
| | | | | | | | | 0 | 1 | 0 | 0 | 4 |
| | | | | | | | | 0 | 1 | 0 | 0 | 4 |
| | | | | | | | | 0 | 1 | 1 | 0 | 6 |
| | | | | | | | | 0 | 1 | 1 | 0 | 6 |
| | | | | | | | | 1 | 0 | 0 | 0 | 8 |
| | | | | | | | | 1 | 0 | 0 | 0 | 8 |
| | | | | | | | | 1 | 0 | 1 | 0 | 10 |
| | | | | | | | | 1 | 0 | 1 | 0 | 10 |
| | | | | | | | | 1 | 1 | 0 | 0 | 12 |
| | | | | | | | | 1 | 1 | 0 | 0 | 12 |
| | | | | | | | | 1 | 1 | 1 | 0 | 14 |
| | | | | | | | | 1 | 1 | 1 | 0 | 14 |
| 0 | 1 | 1 | 1 | 1 | 1 | 0 | 1 | | | | | |
| 0 | 1 | 1 | 1 | 1 | 1 | 1 | 0 | | | | | |
| 0 | 1 | 1 | 1 | 1 | 1 | 1 | 1 | | | | | |

128 signals 16 signals

TABLE 4

($D_7$ = "1")

| SECOND ACCESS SIGNAL PORTION | | | | | | | | FIRST ACCESS SIGNAL PORTION | | | | |
|---|---|---|---|---|---|---|---|---|---|---|---|---|
| $A_{11}$ | $A_{10}$ | $A_9$ | $A_8$ | $A_7$ | $A_6$ | $A_5$ | $A_4$ | $A_3$ | $A_2$ | $A_1$ | $A_0$ | DECIMAL NOTATION |
| $D_7$ | $D_6$ | $D_5$ | $D_4$ | $D_3$ | $D_2$ | $D_1$ | $D_0$ | $RA_3$ | $RA_2$ | $RA_1$ | $RA_0$ | |
| 1 | 0 | 0 | 0 | 0 | 0 | 0 | 0 | 0 | 0 | 0 | 0 | 0 |
| 1 | 0 | 0 | 0 | 0 | 0 | 0 | 1 | 0 | 0 | 0 | 1 | 1 |
| 1 | 0 | 0 | 0 | 0 | 0 | 1 | 0 | 0 | 0 | 1 | 0 | 2 |
| 1 | 0 | 0 | 0 | 0 | 0 | 1 | 1 | 0 | 0 | 1 | 1 | 3 |
| | | | | | | | | 0 | 1 | 0 | 0 | 4 |
| | | | | | | | | 0 | 1 | 0 | 1 | 5 |
| | | | | | | | | 0 | 1 | 1 | 0 | 6 |
| | | | | | | | | 0 | 1 | 1 | 1 | 7 |
| | | | | | | | | 1 | 0 | 0 | 0 | 8 |
| | | | | | | | | 1 | 0 | 0 | 1 | 9 |
| | | | | | | | | 1 | 0 | 1 | 0 | 10 |
| | | | | | | | | 1 | 0 | 1 | 1 | 11 |
| | | | | | | | | 1 | 1 | 0 | 0 | 12 |
| | | | | | | | | 1 | 1 | 0 | 1 | 13 |
| | | | | | | | | 1 | 1 | 1 | 0 | 14 |
| | | | | | | | | 1 | 1 | 1 | 1 | 15 |
| 1 | 1 | 1 | 1 | 1 | 1 | 0 | 1 | | | | | |
| 1 | 1 | 1 | 1 | 1 | 1 | 1 | 0 | | | | | |
| 1 | 1 | 1 | 1 | 1 | 1 | 1 | 1 | | | | | |

128 signals 16 signals

Accordingly, in the interlaced scanning operation mode, the second memory portion 17 of the single memory 29 is selected, when the most significant bit $D_7$ of the data selection signal A is logic "1", whereby 128 patterns can be displayed on the assumption that 16 bytes are alloted available for a pattern. Further, upon the most significant output bit $D_7$ being logic "1", the contents stored at the even-numbered addresses in the first memory portion 16 of the single memory 29 are selectively read out twice successively during the odd-numbered field and the succeeding even-numbered field in view of the fact that eight bytes are allotted available for a pattern.

In this way, in the case of the display apparatus described above in conjunction with FIGS. 4 to 6, data of relatively complicated patterns such as Chinese characters and the like are stored in the second memory portion 17 of the single memory 29 with data of relatively simple patterns such as numerals, alphabetical letters and the like being stored in the first memory portion 16 of the memory 29 so that the latter data can be commonly used also in the interlaced scanning operation mode. By virture of such arrangement, the storage capacity required for the data storing means to generate patterns can be reduced to about a half of the total storage capacity of the memory means provided separately for the non-interlaced scanning operation mode and the interlaced scanning operation mode, respectively.

In the case of the display apparatus shown in FIG. 4, the storage of the patterns such as character font and the like in the first memory portion 16 is effected by using sixteen bytes which are divided into two sub-units each comprising eight bytes and alloted with the even-numbered addresses and the odd-numbered addresses, so that the switching or change-over of operation between the non-interlaced scanning mode and the interlaced scanning mode can then be carried out by means of a switch circuit of a simplified construction such as shown in FIG. 6. It will however be appreciated that the data recording or storage in the first memory portion 16 may be realized in other different manners as desired (e.g. sequential recording of the pattern data). Although it is preferred that the storage capacities of the first and the second memory portions 16 and 17 be selected equal to each other, the division of the storage capacities of these memory portions may be made in other ratios, or alternately these memory portions may be implemented by independent ROM's, respectively.

It will now be appreciated that, according to the teaching of the invention, the display operation can be selectively changed over between the non-interlaced scanning mode and the interlaced scanning mode in a rather arbitrary manner. This permits a stable display without flicker to be produced in the non-interlaced scanning mode at the expense of the resolution in the vertical direction in consideration of the phosphor decay (afterglow) characteristic of the CRT as used as well as the types of patterns such as characters and the like to be displayed or in accordance with the preference of user. Alternately, when necessary, the display may be produced in the interlaced scanning mode with a view to producing displays of improved quality with an increased resolution in the vertical direction.

What we claim is:

1. A display apparatus for use with a cathode-ray tube capable of displaying patterns in interlaced scanning and non-interlaced scanning operation modes, comprising:

means for synthesizing a signal to be supplied to said cathode-ray tube:

means for storing data representative of patterns to be displayed;

means for setting said storing means for one of said two operation modes, depending upon the complexity of patterns to be displayed;

means for generating a data selection signal for reading pattern data in said storing means in accordance with information to be displayed and supplying the pattern data which has been read to said signal synthesizing means for synthesizing a signal carrying said information to be displayed; and means for generating a raster line number signal indicative of a scanning line being produced on said cathode-ray tube, said data selection signal and said raster line number signal serving in combination as an access signal to said storing means during said data reading operation.

2. A display apparatus according to claim 1, in which said storing means includes a first memory storing data representative of relatively simple patterns and a second memory storing data representative of relatively complicated patterns, said operation mode setting means includes a generator for generating two control signals out of phase to each other to be supplied to said first and second memories, respectively, for alternative activation of said first and second memories.

3. A display apparatus according to claim 1, in which said storing means includes a single memory having a first memory portion and a second memory portion, said first memory portion storing data representative of relatively simple patterns while said second memory portion storing data representative of relatively of relatively complicated patterns, the number of digits of data per unit pattern in said first memory being larger than in said second memory portion.

4. A display apparatus according to claim 3, in which the pattern data stored in said first memory portion are available both in the interlaced scanning operation mode and in the non-interlaced scanning operation mode, while the pattern data stored in said second memory portion are available only in the interlaced scanning operation mode.

5. A display apparatus according to claim 3, in which said operation mode setting means includes a generator for generating a mode control signal and a switching circuit arranged to receive said data selection signal from said reading means and said raster line number from said raster line number signal generating means for translating the received signals to an access signal and supplying the access signal to said storing means, said switching circuit having first circuit means responsive to said mode control signal for converting said raster line number signal to one of two kinds of first access signal portions, one being adapted for said interlaced scanning operation mode, the other for said non-interlaced scanning operation mode, and second circuit means responsive to said mode control signal for converting said data selection signal to one of two kinds of second access signal portions, one being adapted for accessing any address in both of said first and second memory portions of said single memory in said interlaced scanning operation mode while the other for accessing any address only in said first memory portion of said single memory in said non-interlaced scanning operation mode.

6. A display apparatus according to claim 5, in which said first and second circuit means are in such an arrangement that said raster line number signal assumes the same value for adjacent two raster scanning lines in one frame.

7. A display apparatus according to claim 4 in which said operation mode setting means includes a generator for generating a mode control signal and a switching circuit arranged to receive said data selection signal from said reading means and said raster line number from said raster line number signal generating means for translating the received signals to an access signal and supplying the access signal to said storing means, said switching circuit having first circuit means responsive to said mode control signal for converting said raster line number signal to one of two kinds of first access signal portions, one being adapted for said interlaced scanning operation mode, the other for said non-interlaced scanning operation mode, and second circuit means responsive to said mode control signal for converting said data selection signal to one of two kinds of second access signal portions, one being adapted for accessing any address in both of said first and second memory portions of said single memory in said interlaced scanning operation mode while the other for accessing any address only in said first memory portion of said single memory in said non-interlaced scanning operation mode.

* * * * *